US006823799B2

(12) United States Patent
Gleave

(10) Patent No.: US 6,823,799 B2
(45) Date of Patent: Nov. 30, 2004

(54) ROOF SAFETY SYSTEM

(76) Inventor: David Sutherland Gleave, 23 Maron 2003, Glasgow (GB), 61 4NQ ( * ) Notice: Subject to any disclaimer, the term of this patent is extended or adjusted under 35 U.S.C. 154(b) by 0 days.

(21) Appl. No.: 10/399,822

(22) PCT Filed: Sep. 6, 2001

(86) PCT No.: PCT/GB01/03989

§ 371 (c)(1),
(2), (4) Date: Apr. 21, 2003

(87) PCT Pub. No.: WO02/44496

PCT Pub. Date: Jun. 6, 2002

(65) Prior Publication Data

US 2004/0007150 A1 Jan. 15, 2004

(30) Foreign Application Priority Data

Nov. 28, 2000 (GB) ..... 0028930

(51) Int. Cl.[7] ..... E01B 25/22
(52) U.S. Cl. ..... 104/111; 182/3
(58) Field of Search ..... 104/89, 112, 115, 104/116, 106, 110, 111

(56) References Cited

U.S. PATENT DOCUMENTS

| | | | | |
|---|---|---|---|---|
| 1,500,911 A | | 7/1924 | Whitaker | |
| 4,318,252 A | | 3/1982 | Janson | 52/39 |
| 5,143,170 A | * | 9/1992 | Hunt et al. | 182/3 |
| 5,325,788 A | | 7/1994 | Strickland et al. | 104/119 |
| 6,009,973 A | * | 1/2000 | Woodyard | 182/36 |
| 6,591,940 B2 | * | 7/2003 | Desjardins | 182/36 |

FOREIGN PATENT DOCUMENTS

| | | | |
|---|---|---|---|
| DE | 543222 | 2/1932 | |
| DE | 598883 | 5/1934 | |
| EP | 0593150 B1 | 12/1996 | E04G/21/32 |
| GB | 2078842 | 1/1982 | E04G/21/23 |
| GB | 2328664 | 3/1998 | E04G/21/32 |

* cited by examiner

*Primary Examiner*—S. Joseph Morano
*Assistant Examiner*—Robert J. McCarry, Jr.
(74) *Attorney, Agent, or Firm*—Drinker Biddle & Reath LLP

(57) ABSTRACT

A safety rail system (1) which can be installed on a sloping roof (42) and provides a continuous rail to which a safety rail traveller (62) and associated safety line may be attached comprises one or more longitudinal base units (10) of substantially uniform cross section adapted to be fixed to the surface of a building, and one or more longitudinal rail units (30) of substantially uniform cross section adapted to allow the attachment of a safety rail traveller (62). The base units (10) and rail units (30) are provided with corresponding male and female continuous key portions (12, 36) to permit a base unit and a rail unit to interlockingly engage by longitudinal sliding action.

20 Claims, 6 Drawing Sheets

ROOF SAFETY SYSTEM

The invention relates to a safety rail system for installation on buildings, particularly the roofs of buildings. In particular, the invention relates to a safety rail system which can be installed on a sloping roof and which serves as a barrier to prevent, or at least hinder, snow or other debris falling from the roof onto the ground below.

Known roof safety systems comprise a safety rail or track to which a safety rail traveller and associated safety line may be attached. EP 0 593 150 describes a roof safety system in which a rail is provided at the ridge of a pitched roof. A traveller, such as that disclosed in GB 2 328 664 A, is slideably mounted on the rail, so that a person working on either side of the pitched roof can secure a safety line to the traveller for protection from falling off the roof. Although rail and traveller systems provide the advantage of an attachment point which is easily moved to any position along the length of a roof ridge, the prior art roof safety systems require special fixings and are not readily retrofitted to an existing roof.

It is an object of the present invention to provide a rail and traveller safety system which may be readily fitted to an existing roof or other part of a building without the need to replace any part of the roof or building and without the need for special fixings.

According to a first aspect of the present invention there is provided a safety rail system comprising:

a longitudinal base unit of substantially uniform cross section adapted to be fixed to the surface of a building, and a longitudinal rail unit of substantially uniform cross section adapted to allow the attachment of a safety rail traveller, wherein the base unit and rail unit are provided with corresponding male and female continuous key portions to permit the base unit and rail unit to interlockingly engage by longitudinal sliding action.

Preferably, the system comprises a plurality of base units and rail units which are interconnected to form a continuous rail. This allows a continuous rail to be formed from short units, typically 2 meters long, which may be readily stored and transported to site. Preferably, the rail unit is of equal length to the base unit. Preferably, the joints between adjacent base units are offset from the joints of adjacent rail units. Offsetting the joints in this way results in a strong composite structure with no planes of weakness, and ensures perfect alignment of adjacent rail units, thus creating a smooth, continuous rail on which the traveller may slide or roll.

Preferably, the base unit is provided with a male key portion adapted to slidingly engage with a female key portion in the rail unit. The rail unit will therefore be restrained from movement relative to the base unit in all degrees of freedom except for the longitudinal direction.

Preferably, crimping is applied to the base unit during installation so that the rail unit is also restrained in the longitudinal direction. Alternatively, adhesive may be applied to the base unit and/or the rail unit.

Preferably, the base unit is secured to a sloping roof. Preferably, the roof is a profiled roof, and has a profiled metal sheet at its outer surface comprising adjacent ridges and valleys extending along the line of maximum slope of the roof. Preferably, the base unit is secured to the roof at the ridges of the metal sheet. In this way the safety rail allows water to pass beneath the base unit along the valleys of the metal sheet, while preventing debris and snow from sliding down the roof.

According to one preferred embodiment each base unit is provided with opposed support flanges adapted to be secured to the adjacent surface of the building. Preferably the support flanges are secured to the adjacent surface of the building using any conventional fastener, such as rivets, toggle bolts or drill-drive fasteners.

According to another preferred embodiment the system further comprises at least one fastening plate adapted to be secured between the base unit and the roof, with each base unit being provided with opposed support flanges adapted to be secured to the fastening plate. The fastening plate may be fixed to the surface of a building in any conventional manner.

Preferably the fastening plate is secured by a fixing to a purlin of the roof. Preferably, the support flanges of the base unit are each provided with a plurality of apertures for connection to corresponding apertures in the fastening plate.

Preferably, the roof safety system includes a plurality of fastening plates. Preferably, the fastening plate has a raised central portion adapted to fit with its lower surface on a ridge of a profiled roof. Preferably, the fastening plate has a lower side portion adapted to locate over a valley of the profiled roof with its upper surface flush with the adjacent ridge of the profiled roof.

According to a second aspect of the present invention there is provided a combined safety rail and retaining rail system comprising:

a longitudinal base unit of substantially uniform cross section adapted to be fixed to a sloping surface of a profiled roof, and a longitudinal rail unit of substantially uniform cross section adapted to allow the attachment of a safety rail traveller, wherein the base unit and rail unit are provided with corresponding male and female continuous key portions to permit the base unit and rail unit to interlockingly engage by longitudinal sliding action, wherein the base unit spans between adjacent ridges of the roof, thereby serving as a retaining rail to retain snow and/or debris on said sloping roof while allowing the passage of rain and/or melt water beneath the base unit between adjacent ridges.

The combined safety rail and retaining rail system may comprise one or more features of the safety rail system according to the first aspect.

Preferably, the base units and rail units are made from aluminium, although other materials, including alloys and composites, are envisaged. The base units and rail units may be produced using any known manufacturing process for parts of uniform cross section, such as extrusion for metals or pultrusion for plastics or composites.

Embodiments of the invention will now be described, by way of example only, with reference to the accompanying figures, where:

Figure 1:
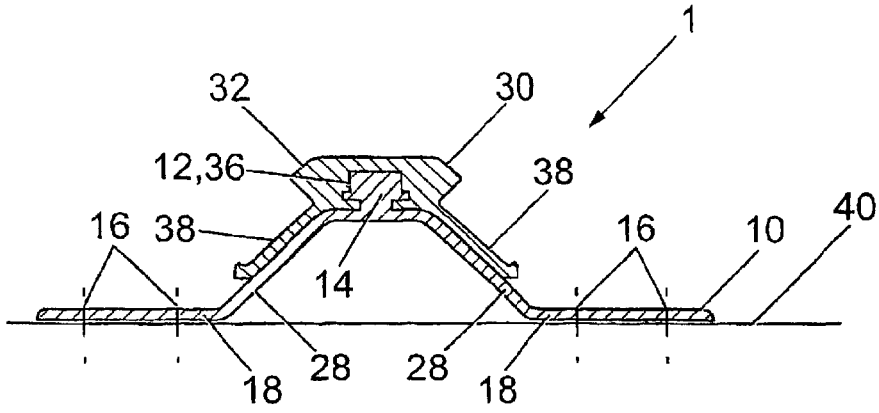
FIG. 1 is a cross sectional view of a safety rail system according to a first embodiment of the invention.

Referring to FIG. 1 there is shown a safety rail system 1 according to a first embodiment of the present invention comprising a longitudinal base unit 10 of substantially uniform cross section and a longitudinal rail unit 30 of substantially uniform cross section. The base unit 10 and the rail unit 30 are provided with male and female continuous key portions 12, 36 respectively to permit the base unit 10 and rail unit 30 to interlockingly engage by longitudinal sliding action. In particular, the base unit 10 includes a narrow waist section 14 to prevent any vertical or rotational movement of the rail unit 30 relative to the base unit 10 when a tensile force is applied to the rail unit 30, such as by an attached safety traveller 62 (shown in FIG. 6) and associated safety line (not shown) carrying a load. The outer surface 32 of the rail unit 30 is formed as a rail adapted to allow the rolling attachment of a safety rail traveller 62.

Both the base and the rail units 10, 30 are of equal length, typically 2000 mm, and are aluminium extrusions. The units are transported to site unassembled and are then assembled to form a continuous rail on the building.

Figure 2:
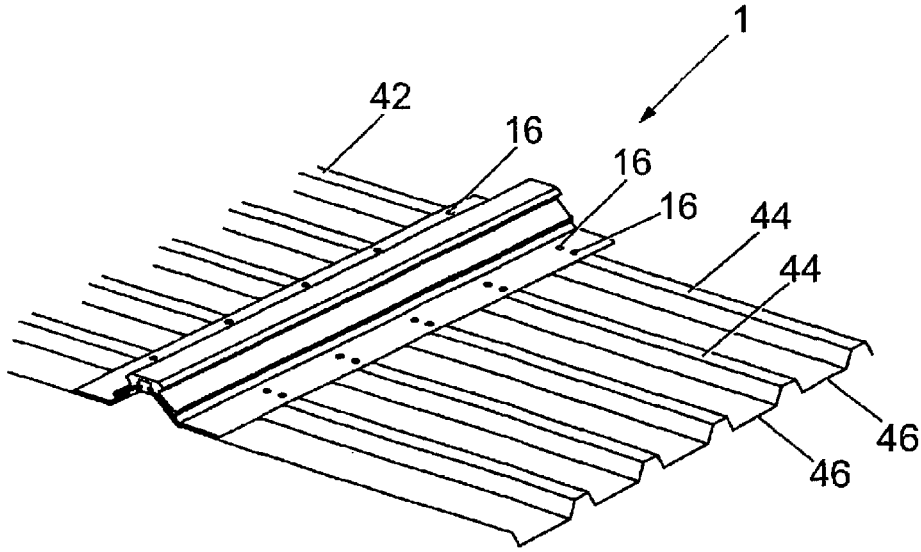
FIG. 2 is an isometric view of the safety rail system of FIG. 1 fixed to a building roof.

Holes 16 may be drilled along the length of the bottom flanges 18 of the base unit 10 during installation to allow the base unit 10 to be fixed to the surface 40 of a building using any conventional manner. Referring to FIG. 2, the building surface 40 is typically a building roof 42 and is typically a profiled roof comprising adjacent ridges 44 and valleys 46 extending along the line of maximum slope of the roof 42. The base unit 10 may be fixed to the building roof 42 at selected ridges 44 of the building roof 42 using any conventional fastener (not shown), for example rivets, driven fasteners, or screws.

Figure 3:
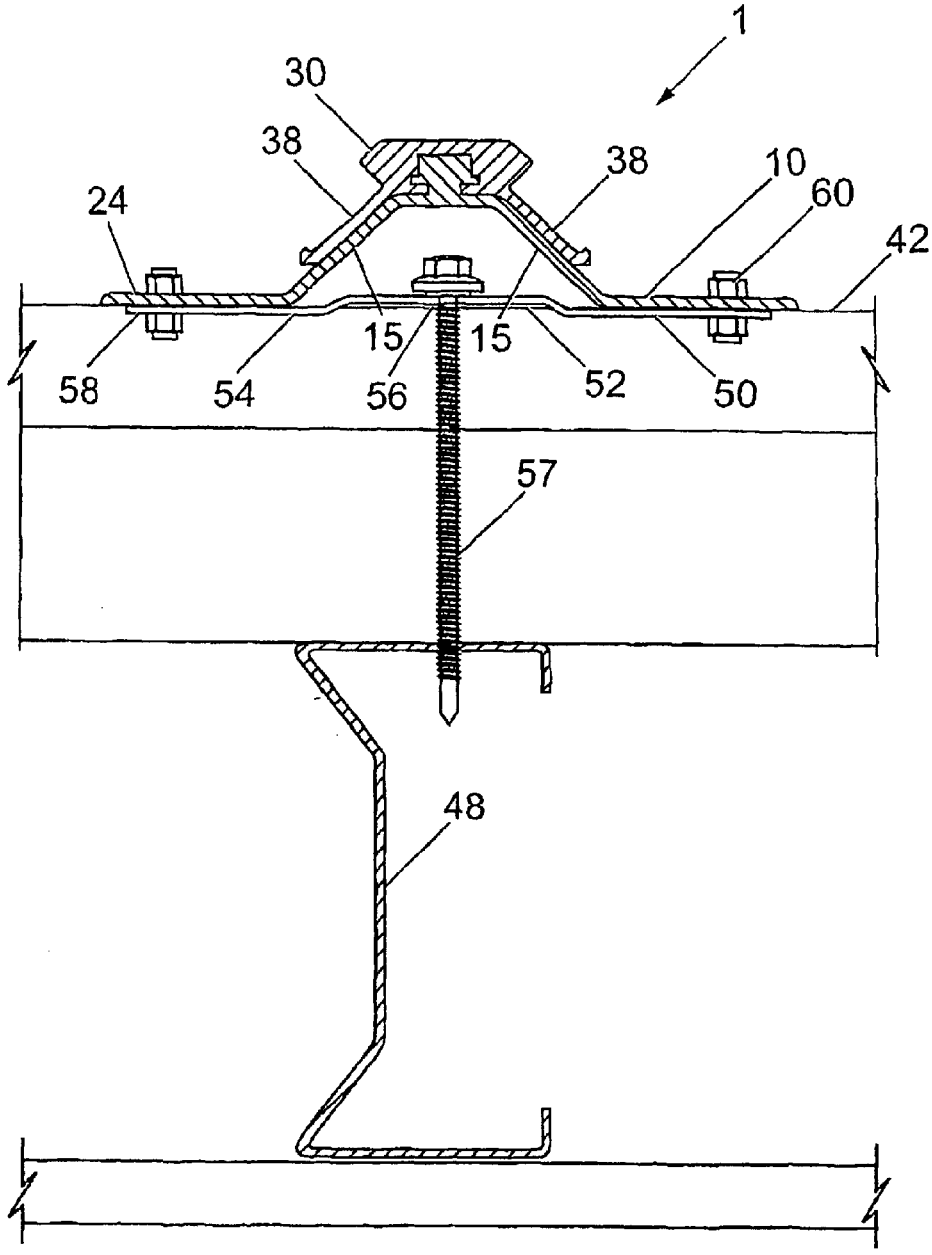
FIG. 3 is a cross sectional view of a safety rail system according to a second embodiment of the invention fixed to a building roof.
Figure 4:
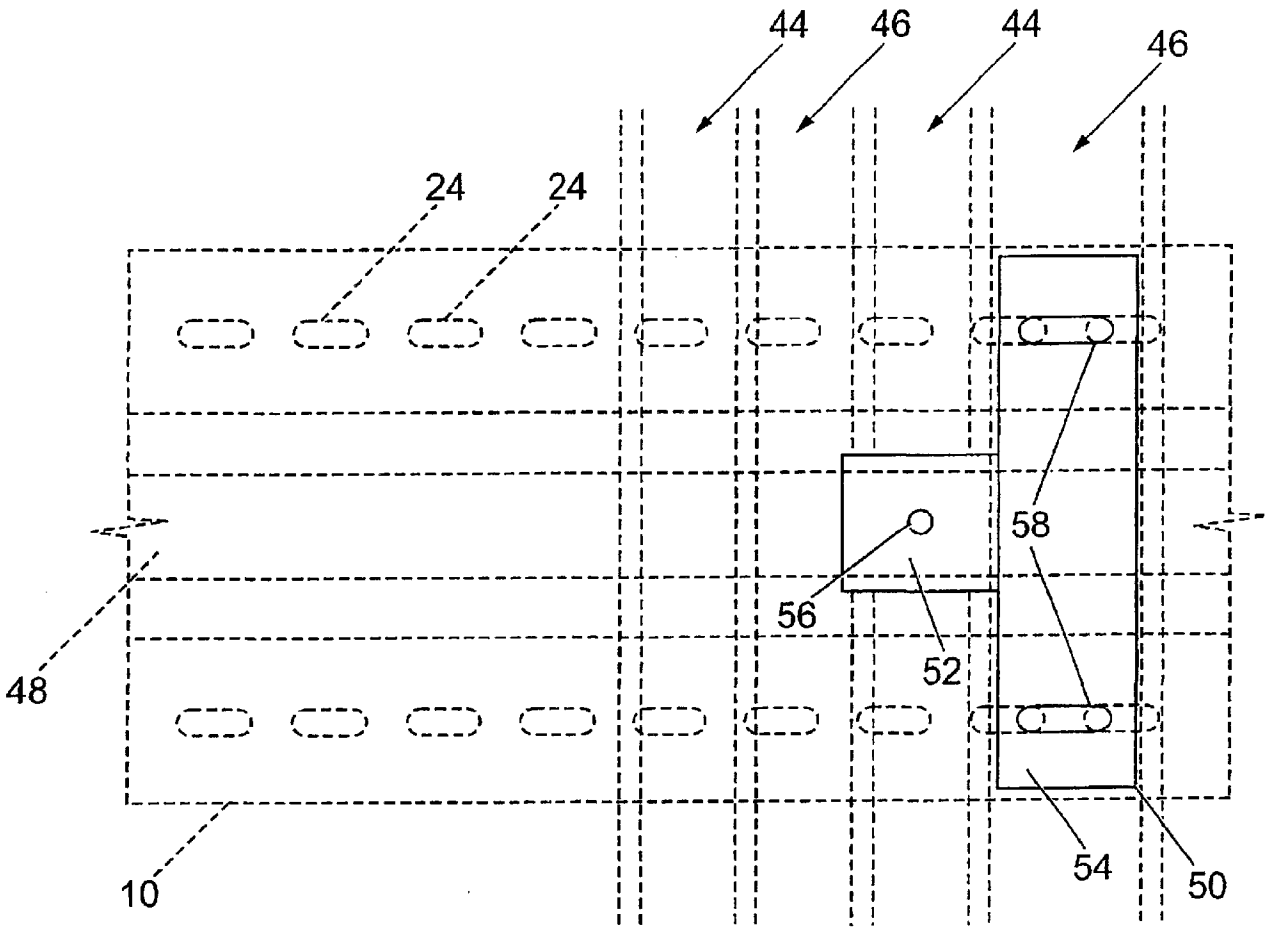
FIG. 4 is a plan view of the fastening plate and the base unit of the safety rail system of FIG. 3 with selected features of the building roof.

FIGS. 3 and 4 show an alternative means of fixing the roof safety system 1. The base unit 10 and rail unit 30 are substantially identical to those shown in FIG. 1, but the system further includes a number of fastening plates 50.

The fastening plate 50 has a raised central portion 52 adapted to fit with its lower surface on a ridge 44 of a profiled roof 42. The fastening plate 50 has a lower side portion 54 adapted to locate over a valley 46 of the profiled roof 42 with its upper surface flush with the adjacent ridge 44 of the profiled roof 42. The fastening plate 50 has an aperture 56 for fixing the fastening plate 50 to the building roof 42. The fastening plate 50 is fixed to the building roof 42 using a fixing screw 57 which extends through the building roof 42 and into a roof purlin 48.

Both the base unit 10 and the fastening plate 50 are provided with slots 24, 58 to allow fastening of the base unit 10 to the fastening plate 50 using any conventional fastener 60, such as a screw bolt and nut. The fixing screw 57 is then covered from view and has increased protection from the environment. The slots 24 in the base unit 10 are factory formed and are spaced and dimensioned such that no matter where the slot 58 in the fastening plate 50 is located, at least one base unit slot 24 will be accessible beneath the plate slot 58.

In practice fastening plates will be provided at a predetermined spacing along the length of the safety rail. The optimum position for the safety rail 1 is directly over a purlin 48, as seen in FIG. 3.

Figure 5:
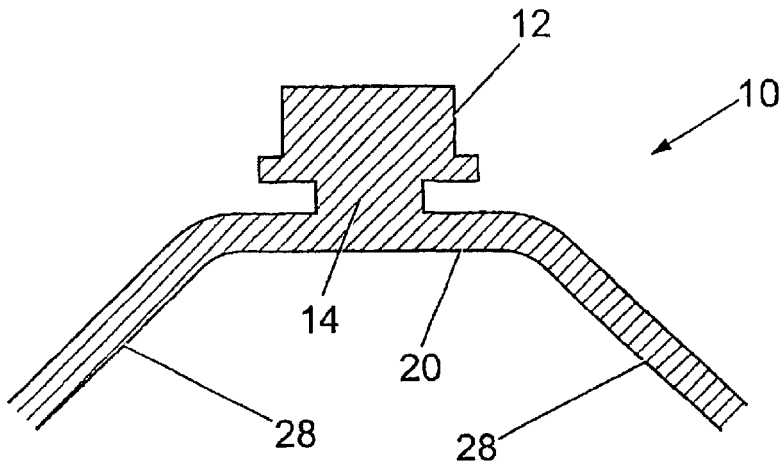
FIG. 5 is an enlarged cross sectional view of part of the base unit according to the safety rail system of FIG. 1 or 3.

The profile of the base unit 10 is shown in greater detail in FIG. 5. In particular the male continuous key portion 12 of the base unit 10 is shown. The male continuous key portion 12 has a waist section 14 of reduced width, so that corresponding protrusions within the female key portion 36 of the rail unit 30 engage with the waist section 14 to prevent the rail unit 30 from moving relative to the base unit 10 in all degrees of freedom except in the longitudinal direction. The rail unit 30 has depending legs 38 which engage against the webs 28 of the base unit 10 to provide further resistance to relative rotation of the base unit 10 and rail unit 30.

The safety rail 1 is assembled by sliding a rail unit 30 onto a base unit 10, leaving an overhang at one end. A second base unit 10 is then joined to the overhanging portion of the first rail unit 30 by sliding action. The second rail unit 30 is then joined to the second base unit and so on.

The inclined under-surfaces 15 of the base unit 10 may be crimped or stamped intermittently along its length. A suitable crimping force is used to cause a local deformation that holds the base unit 10 and rail unit 30 together without deforming the outer surface 32 of the rail unit 30. Alternatively, adhesive may be applied to the rail unit 30 and/or the base unit 10 during installation so that, following curing of the adhesive, the rail unit 30 will be restrained in all degrees of freedom.

Figure 6:
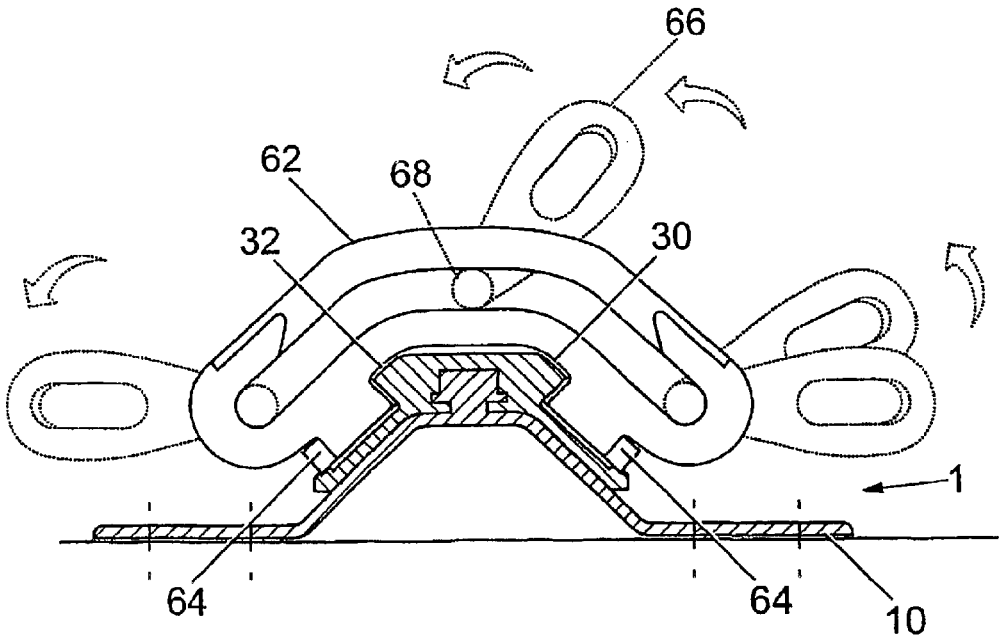
FIG. 6 is a cross sectional view of the safety rail system of FIG. 1, showing a safety traveller attached.

The outer surface 32 of the rail unit 30 forms a safety rail to which a safety rail traveller 62 can be attached, as shown in FIG. 6. The traveller 62 has rollers 64 that are in rolling engagement with part of the outer surface 32 of the rail unit 30 so that the safety rail traveller 62 may easily move along the length of the safety rail system. The safety rail traveller 62 has an eye connector 66 for the attachment of a safety line (not shown). The eye connector 66 is mounted within the safety rail traveller 62 using a retaining pin 68 which allows selected rotational and transverse movement. The traveller shown in FIG. 6 is a commercially available SAFER-IDGE™ traveller, but other shapes of safety rail and other forms of traveller, including simple sliding travellers, fall within the scope of the invention.

Figure 7:
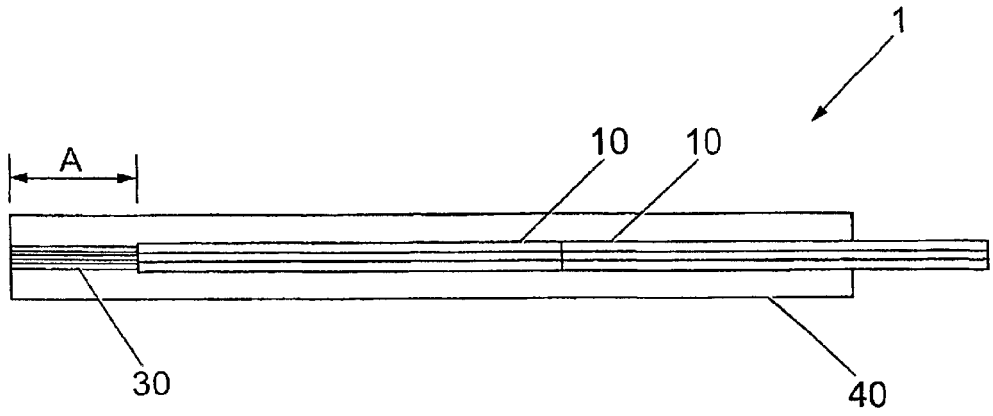
FIG. 7 is a plan view of a safety rail system of FIG. 1 or 3.

FIG. 7 shows a continuous safety rail assembled from a number of base units 10 and rail units 30. The uniform cross section of the base unit 10 and the rail unit 30 is such that a plurality of interconnected base units 10 and rail units 30, laid end to end, will form a continuous rail or track. Once the base units 10 and rail units 30 have been assembled (as described above) the base units 10 are fixed to the building surface 40, or to the prefixed fastening plates 50 (not shown).

Typically, the rail units 30 are positioned so that the joints of the base units 10 are offset from the joints of the rail units 30. The offset distance A is typically 300 mm. This results in a strong composite structure with no planes of weakness, and ensures perfect alignment of adjacent rail units 30, thus creating a smooth, continuous rail on which the traveller 62 may slide or roll.

A section (not shown) can be cut from the base unit 10, typically of 300 mm length, so that both the base unit 10 and the rail unit 30 terminate at a common location at one end of the safety rail. Similarly, a section (not shown) can be cut from the rail unit 30, typically of 300 mm length, so that both the base unit 10 and the rail unit 30 terminate at a common location at the other end of the safety rail. An end stop (not shown) may be provided at each end of the safety rail to prevent the safety rail traveller 62 from disengaging with the safety rail.

Figure 8:
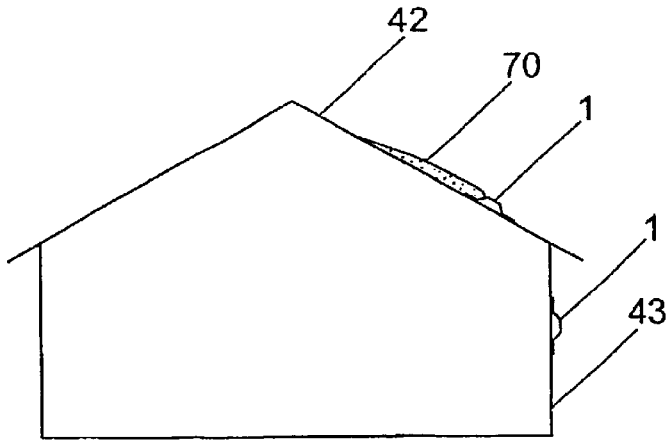
FIG. 8 is a cross sectional view of a safety rail system of FIG. 1 or 3 installed on a roof and a wall of a building.

FIG. 8 shows a safety rail system 1 installed onto two different building surfaces 40, namely a roof 42 and an exterior wall 43. When the safety rail system 1 installed on a pitched roof 42, the rail system functions both as a safety rail and a snow or debris barrier. Any snow 70 that has fallen onto, and remains on, a sloping roof 42 can fall to the ground in large quantities. Also, any debris (not shown) that is blown or thrown onto the roof 42 can unexpectedly fall to the ground, with possible consequential injuries to persons below the roof. These factors represent a hazard and inconvenience to those persons that require passage to or from the building. The combined safety rail and retaining rail system 1 provides a barrier to prevent, or at least hinder, snow 70 and/or debris from falling from the roof 42 onto the ground below. Rain and/or melt water is allowed to flow beneath the base unit 10 within the valleys 46 of the roof 42, while large bodies of snow or large objects are trapped by the safety rail.

Figure 9:
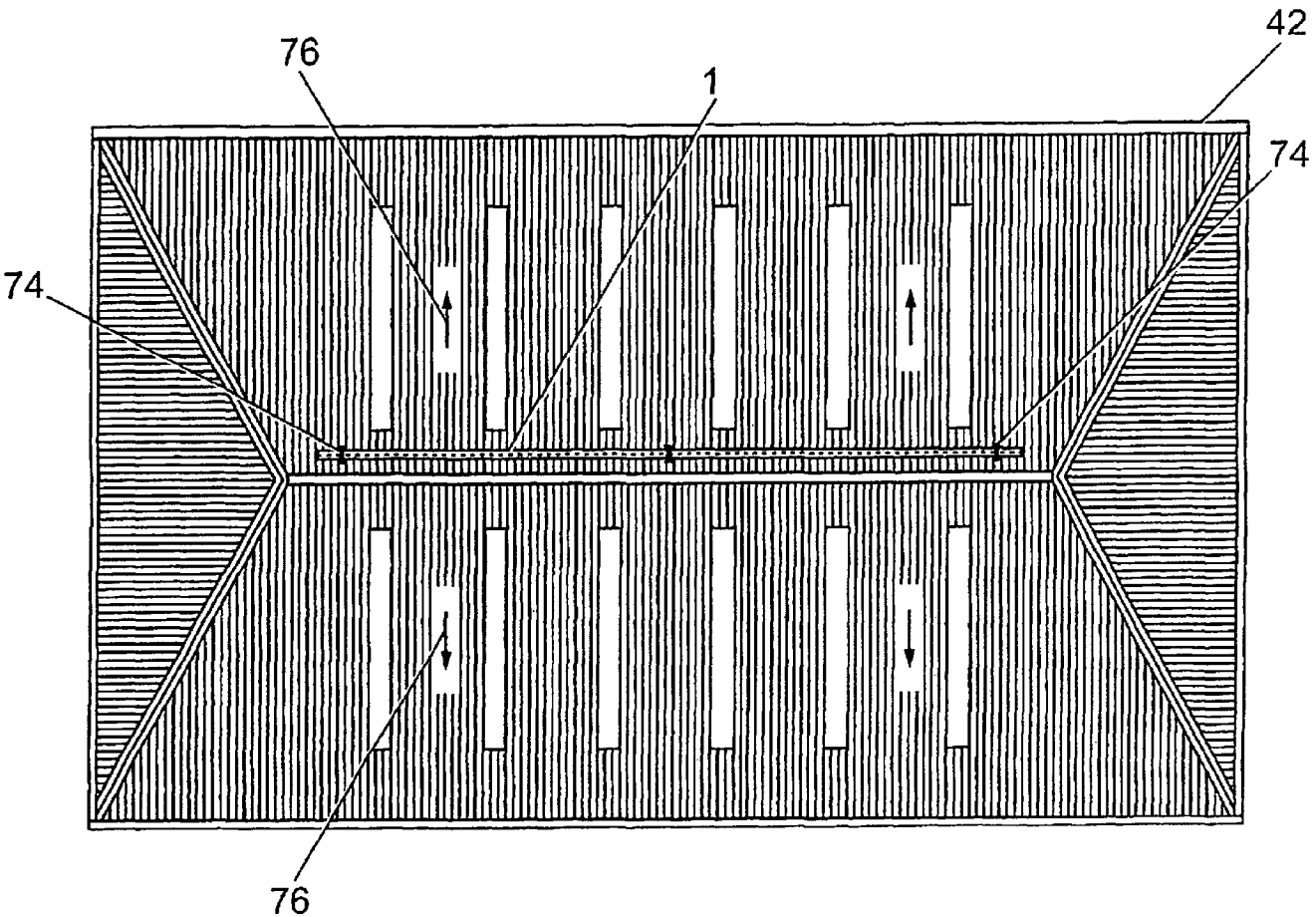
FIG. 9 is a plan view of a safety rail system of FIG. 1 or 3 installed on a hip ended roof of a building.

FIG. 9 shows a safety rail system 1 installed onto one type of roof, namely a hip ended roof. The slope, or fall, of the roof is indicated by arrows 76. End stops 74 are provided to prevent the traveller 62 from disengaging from the rail system 1.

Modifications and variations to the invention described above are possible. For example, the base unit 10 and rail unit 30 may have different shapes from those illustrated. The safety rail may have a different shape, depending on the shape of traveller used. The safety rail may comprise a slot in the rail unit, along which a traveller may slide. The safety rail may be attached to a pitched roof just below the ridge or at any other location. Various fasteners may be used to attach the base units 10 to the roof, including rivets, toggle bolts, drill-drive fasteners. The system may be employed on a planar roof (without valleys) if spacer blocks (typically 10 mm high) are used beneath the base unit, to allow the passage of water beneath the base unit.

What is claimed is:

1. A safety rail system secured to a building comprising:

a plurality of longitudinal base units of substantially uniform cross section arranged end to end with joints between adjacent base units, each base unit being secured to the building, a plurality of longitudinal rail units of substantially uniform cross section arranged end to end with joints between adjacent rail units to form a continuous horizontal rail, and a safety rail traveller attached to the rail such that the traveller can travel along the rail, wherein each base unit and each rail unit are provided with corresponding male and female continuous key portions extending the length of each unit from end to end to permit the base unit and rail unit to interlockingly engage by longitudinal sliding action, and wherein each rail unit extends parallel to and is interlockingly engaged with two base units by means of said corresponding male and female continuous key portions, such that the joints between adjacent base units are offset from the joints between adjacent rail units.

2. A safety rail system according to claim 1, wherein the rail units and base units are of equal length.

3. A safety rail system according to claim 1, wherein each base unit is provided with a male key portion adapted to interlockingly engage by longitudinal sliding action with a female key portion provided in each rail unit.

4. A safety rail system according to claim 3, wherein each base unit is provided with opposed support flanges adapted to be secured to an adjacent surface of a building.

5. A safety rail system according to claim 1, wherein crimping is applied to one or both of the base unit and the rail unit to restrain the rail unit in the longitudinal direction.

6. A safety rail system according to claim 1, wherein each base unit is secured to a sloping roof.

7. A safety rail system according to claim 6, wherein the roof is a profiled roof having a profiled metal sheet at its outer surface comprising adjacent ridges and valleys extending along a line of slope of the roof, and wherein each base unit is secured to the roof at one or more ridges of the metal sheet.

8. A safety rail system according to claim 1, further comprising a plurality of fastening plates, each fastening plate being secured between a base unit and the roof, wherein the or each base unit is provided with opposed support flanges secured to the fastening plate.

9. A safety rail system according to claim 7, wherein each base unit is secured to a sloping roof.

10. A safety rail system according to claim 8, wherein the support flanges of each base unit are each provided with one or more apertures for connection to corresponding apertures in the fastening plate.

11. A safety rail system according claim 8, wherein each fastening plate has a raised central portion adapted to fit with its lower surface on a ridge of a profiled roof.

12. A safety rail system according to claim 11, wherein each fastening plate has a lower side portion adapted to locate over a valley of the profiled roof with its upper surface flush with the adjacent ridge of the profiled roof.

13. A safety rail system secured to a roof comprising:

a plurality of longitudinal base units of substantially uniform cross section arranged end to end with joints between adjacent base units and fixed to the roof, and a plurality of longitudinal rail units of substantially uniform cross section arranged end to end with joints between adjacent rail units to form a continuous horizontal rail and adapted to permit a safety rail traveller to be attached to the rail such that the traveller can travel along the rail, wherein each base unit and each rail unit are provided with corresponding male and female continuous key portions to permit each of said base units and each of said rail units to interlockingly engage by longitudinal sliding action, wherein each rail unit is interlockingly engaged with two base units by means of said corresponding male and female continuous key portions, such that they joints between adjacent base units are offset from the joints between adjacent rail units, and wherein the roof is a profiled roof having a profiled metal sheet at its outer surface comprising adjacent ridges and valleys extending along a line of slope of the roof, and wherein each base unit is secured to the roof at one or more ridges of the metal sheet.

14. A system according to claim 13, wherein the rail units and base units are of equal length.

15. A system according to claim 13, wherein each base unit is provided with opposed support flanges adapted to be secured to an adjacent surface of a building.

16. A system according to claim 13, further comprising a plurality of fastening plates, each fastening plate being secured between a base unit and the roof, wherein the or each base unit is provided with opposed support flanges secured to the fastening plate.

17. A system according to claim 16, wherein each fastening plate has a raised central portion adapted to fit with its lower surface on a ridge of a profiled roof.

18. A system according to claim 17, wherein each fastening plate has a lower side portion adapted to locate over a valley of the profiled roof with its upper surface flush with the adjacent ridge of the profiled roof.

19. The use of a safety rail system according to claim 13, wherein each base unit spans between adjacent ridges of the roof and serves as a retaining rail to retain snow and debris on said sloping roof while allowing the passage of rain and melt water beneath the base unit along the valley between adjacent ridges.

20. A safety rail system according to claim 8, wherein each base unit is secured to a sloping roof.

* * * * *

UNITED STATES PATENT AND TRADEMARK OFFICE

CERTIFICATE OF CORRECTION

PATENT NO. : 6,823,799 B2
DATED : November 30, 2004
INVENTOR(S) : David Sutherland Gleave It is certified that error appears in the above-identified patent and that said Letters Patent is hereby corrected as shown below:

Column 6,
Line 46, change “such that they joints” to read -- such that the joints --.

Signed and Sealed this

Twelfth Day of April, 2005

JON W. DUDAS
*Director of the United States Patent and Trademark Office*